United States Patent [19]

Ivanova et al.

[11] 4,061,551

[45] Dec. 6, 1977

[54] PROCESS FOR EXTRACTION OF GALLIUM FROM ALKALINE GALLIUM-CONTAINING SOLUTIONS

[76] Inventors: Raisa Vasilievna Ivanova, ulitsa Udaltsova, 14, kv. 181; Arkady Andreevich Belsky, ulitsa Udaltsova, 14, kv. 65; Nikolai Alexandrovich Novikov, ulitsa Korolenko, 4/14, kv. 10; Nina Nikolaevna Alexeeva, ulitsa Obrucheva, 28, korpus 3, kv. 206; Ljudmila Nikolaevna Nikitina, Berezhkovskaya naberezhnaya, 12, kv. 323; Nina Andreevna Ljubimova, 11 Parkovaya ulitsa, 44, korpus 4, kv. 36, all of Moscow; Anna Evgenievna Dotsenko, prospekt Lenina, 66, kv. 23, Balashikha, Moskovskoi oblasti, all of U.S.S.R.

[21] Appl. No.: 604,952

[22] Filed: Aug. 15, 1975

[51] Int. Cl.[2] ..... C25C 1/22

[52] U.S. Cl. ..... 204/105 R

[58] Field of Search ..... 204/105 R

[56] References Cited

U.S. PATENT DOCUMENTS

| | | | |
|---|---|---|---|
| 2,016,442 | 10/1935 | Kilgus | 204/129 |
| 2,793,179 | 5/1957 | Breteque | 204/105 R |
| 3,207,684 | 9/1965 | Dotts | 204/180 R |
| 3,677,918 | 7/1972 | Miyake | 204/105 R |
| 3,719,583 | 3/1973 | Ustick | 204/180 R |
| 3,897,317 | 7/1975 | Bawa | 204/105 R |

*Primary Examiner*—R. L. Andrews

*Attorney, Agent, or Firm*—Lackenbach, Lilling & Siegel

[57] ABSTRACT

A process for the extraction of gallium from alkaline gallium-containing solutions comprises electrochemically reducing gallium on liquid metal materials in an alternating electromagnetic field.

9 Claims, No Drawings

PROCESS FOR EXTRACTION OF GALLIUM FROM ALKALINE GALLIUM-CONTAINING SOLUTIONS

The invention relates to processes for the extraction of dissipated rare metals from solutions, and in particular it is concerned with a process for the extraction of gallium from alkaline gallium-containing solutions. The process may be used in extracting gallium from alkaline solutions containing alkali metal carbonates, phosphates, chlorides, fluorides, aluminates, vanadates, chromates, molybdates, silicates, ferrates, zincates.

Solutions of the above composition with an elevated gallium content result in processing of bauxites and nephelines.

In processing bauxites, such solutions are circulating alkaline-aluminate solutions in the alumina production, in processing nephelines — circulating soda-potash mother liquors in the potash production.

At present gallium is used as a component of semiconductor compounds of the $A^{III}B^{V}$ type, dental alloys, liquid collectors in electrical machines, working medium in radioactive systems, as well as in high-temperature thermometers.

It is known to extract gallium from alkaline solutions by electrochemically reducing gallium either through electrolysis or contact reduction.

Cathodes of solid metals and alloys, such as iron and steel resistant to alkaline solutions, as well as of liquid metals, such as mercury, gallium and mercury-sodium alloys — sodium amalgams- are used in electrolysis.

The anode preferably comprises nickel. During the contact reduction, gallium is reduced into metal in an alkaline solution as a result of contact redox reactions between gallium ions in the solution and a metal having a higher oxidation potential than gallium.

Oxidized metal remains in the solution, and the reduced metal is extracted therefrom.

The above-described electrolysis and contact reduction methods are used for obtaining gallium from alkaline solutions including those occurring in the production of aluminium hydroxide by the Bayer method and other methods employed in processing aluminium ores.

Impurities, such as chromium, vanadium and iron present in the solution considerably reduce the extraction of gallium so that the solutions are preferably purified to remove the impurities prior to the reduction of gallium.

The main disadvantages of the production methods of obtaining gallium based on electrochemical reduction of gallium on mercury and amalgams resides in toxicity of mercury.

Conventional methods of purification of solutions from impurities hampering the extraction of gallium either by cooling and crystallization or by reduction or reaction with calcium hydroxide enable but a certain improvement of the production performance when reducing gallium electrochemically.

At the same time, the use of each of the above-mentioned purification methods separately does not provide for removal of impurities hampering the electrochemical reduction of gallium with a required degree of completeness.

Known in the art is a process for the extraction of gallium from alkaline gallium-containing solutions comprising electrochemically reducing gallium on liquid mercury alloys containing sodium in an amount of 0.6–0.8% by mass, the alloy being displaced by means of a propeller agitator rotating at 15 rpm.

The disadvantage of this process is associated with the employment of mercury.

The disadvantage of the electrochemical reduction of gallium on sodium-containing mercury alloys resides in a low solubility of gallium in mercury and complicated subsequent separation of gallium and mercury so that the process of gallium extraction cannot be made highly efficient.

This process cannot provide for efficient displacement of the liquid alloy and solution due to the development of a plane-parallel motion in the layer of liquid alloy and solution which results in an impaired mass exchange therebetween. Furthermore, this process does not permit to control the intensity of the reaction.

It is an object of the invention to provide a process for the extraction of gallium which permits to obtain purer metal and enables continuous processing with controlled intensity.

With this and other objects in view, the invention consists in the provision of a process for the extraction of gallium from alkaline gallium-containing solutions comprising electrochemically reducing gallium on liquid metal materials, wherein, according to the invention, electrochemical reduction of gallium is conducted in an alternating electromagnetic field.

Liquid metal material used in the electrochemical reduction of gallium preferably comprises liquid gallium, gallium alloys containing aluminum in an amount of 0.05–0.5% by mass, as well as gallium alloys containing aluminum and zinc in an amount of 0.05–0.5% and 0.1–10% by mass, respectively.

The application of electromagnetic field provides favourable conditions for efficient displacement of the liquid metal material and to a considerable extent eliminates the influence of passivating films formed on the surface of the liquid metal cathode material during the electrochemical extraction of gallium from alkaline solutions.

The application of an alternating electromagnetic field provides for displacement of liquid metal material in a predetermined direction relative to the solution at controlled intensity by modifying the nature of movement between laminar and turbulent movement, and also provides favourable conditions for uniform distribution of aluminum and zinc in liquid metal material, where respective gallium-based alloys are used as liquid metal material.

The introduction of aluminum in the alloy of the above-specified concentration provides for a potential difference necessary for contact electrochemical reduction of gallium, while zinc lowers the solubility of impurities in gallium.

The electrochemical reduction of gallium is preferably conducted in an alternating electromagnetic field with cathode polarization of liquid metal material with direct current at a current density of 0.001–0.1 $A/cm^2$.

With the cathode polarization of alloy, gallium yield by current may attain 40–45%, and aluminum consumption is 2 g per g of extracted gallium.

The process for the extraction of gallium from alkaline gallium-containing solutions of the alumina production which contain impurities hampering the extraction of gallium may be made more efficient by reducing these impurities and removing them from the solution prior to the electrochemical reduction of gallium.

The impurities are preferably reduced by treating the solutions with a reducer having the oxidation potential which is higher than the reduction of potential of the impurity, whereafter the reduced impurities may be readily removed either by filtering or settling or by treating the solution with a reactant containing an alkaline earth metal.

The invention improves the efficiency of the process for the extraction of gallium from alkaline gallium-containing solutions due to the conduct of the process of electrochemical reduction in an alternating electromagnetic field while using new compositions of gallium-based alloy and such conditions which permit to extract up to 90% of gallium from a solution for 1–2 hours with high gallium yield by current (40–45%) with aluminum consumption of 2–17 g per 1 g of extracted gallium. The process according to the invention enables the production of the metal containing impurities such as copper in an amount of $1–2.10^{-4}–10^{-3}$% by mass.

In accordance with the invention, the process is carried out in the following manner. An alkaline gallium-containing solution is contacted with a liquid metal material, such as gallium-based alloy containing 0.05–0.5% by mass of aluminum. The alloy and solution are contacted in an alternating electromagnetic field with an intensity of 1500–500,000 A/m. Liquid metal materials may comprise gallium-aluminum alloys containing zinc.

This concentration of aluminum provides for potential difference required for reducing gallium contained in the alkaline solution, the upper limit of concentration being determined by the margin of saturation with aluminum at the process temperature.

The process is conducted at a temperature which is higher than the crystallization temperature of the liquid metal material and lower than the boiling point of the solution.

Upon contacting the solution with the above-described alloy, an oxidation-reduction reaction occurs, whereby aluminum is dissolved in the solution and the reduced gallium is extracted therefrom. In order to provide for continuous processing with uninterrupted extraction of gallium from the solution and to obtain the best performance, a predetermined amount of aluminum is continuously added to the alloy.

After the process is completed, the solution is separated from the alloy which is subsequently processed to obtain metallic gallium.

When the process is conducted continuously, the solution is passed at a predetermined rate through the zone of contact thereof with the above-mentioned alloy.

Another embodiment of the process according to the invention consists in that the alloy is connected by means of a conductor to the negative terminal of a current source, and an anode is placed into the solution and connected to the positive terminal of the current source.

Direct current is passed through the solution and alloy with a current density in the alloy from 0.001 to 0.1 A/cm$^2$, the alloy being cathode polarized.

In this case the reduction process is conducted at a higher speed, and its reliability is improved because even in case of complete dissolution of aluminum from the alloy the process of extraction of gallium from the solution will continue due to the current supplied from an external source.

In extracting gallium from the solutions occurring in the alumina production, impurities, such as vanadium, chromium, chlorine, sulphur, organic products, silicon and iron hampering the reduction of gallium are preliminarily removed.

Thus, the solution is heated at 50°–100° C and treated with a reducer, such as aluminum, gallium-based alloys containing aluminium or aluminum and zinc. For reduction of the impurities, direct current and substances having the reducing properties, such as hydrazine and salts thereof, ferric sulfate, sodium sulphide may be used. The treatment is conducted until the reduction of impurities such as vanadium and chromium which are then removed. Subsequently, the solution is treated, if necessary with a reactant containing an alkaline-earth element, such as calcium oxide, calcium hydroxide or magnesium hydroxide and/or calcium-containing rejects of the alumina production. After this step, the solution is separated from the precipitates and processed in accordance with one of the above-described embodiments.

Where only such impurities as vanadium and chromium in amounts hampering the electrochemical reduction of gallium are present in an alkaline gallium-containing solution, the process according to the invention may be carried out in the following manner.

An alkaline gallium-containing solution also containing vanadium and chromium is treated with a reducer to reduce vanadium and chromium, and, since the reduced forms of these impurities are hardly soluble in the alkaline solution, the impurities are removed either by filtering or by settling, and the solution is fed for electrochemical reduction of gallium.

In alkaline gallium-containing solutions containing more than 150 g/l of sodium oxide, the solubility of reduced chromium compounds becomes higher, and the removal thereof with a required degree of completeness is impossible so that better results of elimination of chromium impurities as well as other impurities, e.g. iron can be obtained by reducing the impurities with subsequent removal thereof by treating with a reactant containng an alkaline-earth element.

In alkaline gallium-containing solutions containing more than 150 g/l of sodium oxide there are normally such impurities as copper, iron, titanium, nickel, molybdenum which would accumulated in gallium used for a long time as the base of liquid metal material for electrochemical reduction to impair quality of the extracted metal.

Therefore, in extracting gallium from such solutions, the process according to the invention may be carried out in the following manner.

A starting alkaline gallium-containing solution is contacted with a gallium-based alloy containing either aluminum or aluminum and zinc.

After a certain time of contact during which the electrochemical reduction of a considerable amount of impurities and of insignificant amount of gallium (preliminary reduction) takes place, the solution is contacted with a fresh batch of the alloy.

According to the invention pure gallium may also be used as liquid metal material. In this case the process is conducted in accordance with one of the above-described embodiments, and gallium is necessarily polarized with direct current with a current density from 0.001 to 0.1 A/cm$^2$.

Polarization of the alloy with direct current with a current density from 0.001 to 0.1 A/cm$^2$ is the means of improving the efficiency of the process.

The invention will be better understood from the following specific examples illustrating the process according to the invention.

EXAMPLE 1

Gallium was extracted from a solution containing 100 g/l of sodium hydroxide and 0.25 g/l of gallium by electrochemically reducing gallium on gallium alloy containing 0.5% of aluminum.

The solution was contacted with the alloy at 45° C in an alternating electromagnetic field of an intensity 60000 A/m.

After 20 minutes of treatment the degree of extraction of gallium from the solution was 95%.

EXAMPLE 2

Gallium was extracted from a solution containing 180 g/l of sodium hydroxide, 45 g/l of sodium carbonate, 135 g/l of aluminum oxide, 0.17 g/l of gallium by electrochemically reducing gallium on gallium alloy containing 0.15% by mass of aluminum and 5% by mass of zinc. Concentration of aluminum in the alloy was maintained during the processing at the above-specified level by adding metallic aluminum to the alloy in the amount equal to the amount of aluminum dissolved in the solution as a result of electrochemical reducton of gallium. The process was conducted in an electromagnetic field with an intensity of 60000 A/m.

The degree of gallium extraction from the solution was 90% after 1.75 hours of treatment with the consumption of 17 g of aluminum per g of extracted gallium.

EXAMPLE 3

Gallium was extracted from an alkaline solution having the same composition as described in Example 2 by electrochemically reducing gallium on gallium alloy containing 0.5% by mass of aluminum and 5% by mass of zinc. The alloy was cathode polyrized with a current density of 0.001 A/cm². The process was conducted in an electromagnetic field with an intensity of 45000 A/m. Concentration of aluminum and zinc in the alloy was maintained as described in Example 2.

The degree of gallium extraction from the solution was 90% after 60 minutes of treatment with the yield by current of 45% and aluminum consumption of 8 g per g of extracted gallium.

EXAMPLE 4

The composition of solution and conditions of experiment were similar to those described in Example 3, the only difference consisting in that the alloy was polarized with a current density of 0.01 A/cm².

The degree of gallium extraction was 90% after 55 minutes of treatment with the yield by current if 42% and aluminum consumption of 7.5 g per g of extracted gallium.

EXAMPLE 5

The composition of solution and conditions of test were similar to those described in Example 3, the only difference consisting in that the alloy was polarized with a current density of 0.05 A/cm².

The degree of gallium extraction was 90% after 25 minutes of treatment with the yield by current of 11.1% and aluminum consumption of 4.2 g per g of extracted gallium.

EXAMPLE 6

The composition of solution and conditions of experiment were similar to those described in Example 3, the only difference consisting in that the alloy was polarized with a current density of 0.1 A/cm².

The degree of gallium extraction was 90% after 15 minutes of treatment with a yield by current of 9.6% and aluminum consumption of 3.2 g per g of extracted gallium.

EXAMPLE 7

A solution containing in g/l: sodium carbonate, 246; sodium hydroxide, 19; aluminum oxide, 10; chromium, 0.8; vanadium, 0.08; gallium, 0.15 was treated, prior to the electrochemical reduction, with metallic aluminum in the powdered form to reduce chromium and vanadium to the lowest valency, whereafter the solution was treated with an aqueous solution of calcium oxide at 90°-100° C.

After separation of a precipitate, the solution had the following composition in g/l; sodium carbonate, 124; sodium hydroxide, 111; aluminum oxide 8; chromium, 0.001; vanadium, 0.003; and gallium, 0.14.

Gallium was extracted from the solution by electrochemically reducing gallium on gallium alloy containing 0.25% by mass of aluminum. The process was conducted in an alternating electromagnetic field with an intensity of 60000 A/m. The solution was displaced relative to the alloy by causing it to flow through an apparatus for electrochemical reduction of gallium.

The degree of gallium extraction was 92% after 60 minutes of treatment with aluminum consumption of 16 g per g of gallium extracted.

EXAMPLE 8

Circulation solution of the alumina production containing in g/l: sodium carbonate, 145; sodium hydroxide, 240; aluminum oxide, 65; vanadium, 0.17; chromium, 0.06; gallium, 0.22 was treated with a reducer - sodium sulphide - in an amount of 2 g per 1 g of the solution and with calcium hydroxide - milk of lime- at 90°-100° C during two hours.

After separation of precipitate, the solution had the following composition in g/l: sodium carbonate 60; sodium hydroxide 204; aluminum oxide 31; vanadium less than 0.003; chromium less than 0.003; gallium 0.17.

To this solution there was added zinc oxide in an amount equal to the gallium content in the solution so as to provide for concentration of sinc in the gallium based aluminum containing alloy of 8% by mass during the reduction.

Gallium was extracted from the solution in the conditions similar to those described in Example 7. The degree of gallium extraction was 87% after 45 minutes of treatment with aluminum consumption of 14 g per g of extracted gallium.

EXAMPLE 9

Gallium was extracted from a circulation solution of the alumina production containing in g/l: chromium 0.01; vanadium 0.03 and gallium 0.17 by electrochemically reducing gallium on gallium based alloys containing aluminum and zinc, the solution being first contacted with an alloy containing 0.2% and 5% by mass of aluminum and zinc, respectively, and then — with a gallium based alloy containing 0.05% by mass of aluminum. Zinc was preliminarily added to the solution in the form of sodium zincate so as to provide for zinc concentration in the solution of 0.15 g/l.

The process was conducted in an alternating electromagnetic field of an intensity of 60000 A/m at 50 Hz frequency.

The degree of gallium extraction was 87% after 60 minutes of treatment with aluminum consumption of 20 g per 1 g of extracted gallium. Copper content in the resulting green metal was $1-310^{-4}$% by mass.

EXAMPLE 10

Gallium was extracted from an alkaline solution containing in g/l: sodium hydroxide 200; chromium 0.6; gallium 0.5 by electrochemically reducing gallium after preliminary purification of the solution from chromium by reducing it with hydrazine sulphate in an amount of 5 g per liter of the solution with subsequent treatement with calcium hydroxide used in an amount ensuring the introduction of 25 g of the reactant in 1 l of the solution based on active calcium oxide.

The solution was treated with the above-specified reactants at 100° C during three hours.

After separation of a precipitate, the concentration of chromium was lowered to 0.005 g/l. Gallium was extracted from the purified solution by reducing on a gallium based alloy containing 0.1% of aluminum under the action of electromagnetic field of an intensity of 60000 A/m. The processing temperature was 60° C.

The degree of gallium extraction was 90% after 45 minuteso of treatment with aluminum consumption of 17 g per g of extracted gallium.

EXAMPLE 11

Gallium was extracted from an alkaline solution containing in g/l: potassium carbonate 403; potassium hydroxide 86; aluminum oxide 28.6; gallium 0.32; chromium 0.02; and iron 0.007 after preliminary purification of the solution, first with a reducer- hydrazine sulphate in the presence of an iron catalyst, and then with calcium oxide.

The consumption of hydrazine sulphate was 200% against the stoichiometric quantity required for reduction of chromium and iron, and the consumption of calcium oxide was determined so as to maintain calcium oxide to aluminum oxide ratio 1:1. Total treatment time was three hours. Process temperature was 80°-100° C.

After separation of a precipitate, the solution had the following composition in g/l: potassium carbonate 260; potassium hydroxide 129; aluminum oxide 11.8; gallium 0.28; chromium less than 0.003; and iron less than 0.005.

In extracting gallium from this solution by electrochemically reducing gallium in an alternating electromagnetic field of an intensity of 150000 A/m on a gallium based alloy containing 0.1% by mass of aluminum and 0.5% by mass of zinc the degree of gallium extraction was 80% after 1.5 hours of treatment with aluminum consumption of 18 g per g of extracted gallium.

EXAMPLE 12

Gallium was extracted from an alkaline solution containing in g/l: sodium carbonate 480; sodium hydroxide 49; aluminum oxide 31.7; chlorine 7.1; gallium 0.29; chromium 0.03; vanadium 0.015; iron 0.006; sulphur 3.48 after a preliminary purification of the solution from impurities by treating with a reducer- ferrous sulphate and with a calcium containing reactant- "white" desiliconization sludge containing in by mass: calcium oxide 30.5; aluminum oxide 20.3; sodium oxide 9.98; silicon dioxide 9.6; magnesium oxide 0.8; and iron oxide 0.6.

The consumption of ferrous sulphate was 200% against the stoichiometric quantity for reduced components of the solution, the sludge consumption being determined in such a manner as to provide the ratio of alkali-earth elements — calcium and magnesium- to aluminum oxide in the solution of 2:1. Total treatment time with the above-specified reactants was 2.5 hours, temperature — 80° C. After separation of a precipitate, the solution had the following composition in g/l: sodium carbonate 378; sodium hydroxide 67; aluminum oxide 36; chlorine less than 0.01; gallium 0.27; chromium less than 0.003; vanadium less than 0.003; iron less than 0.0015; sulphur 3.00.

Gallium was extracted from the solution thus obtained by the method described in Example 11.

The degree of gallium extraction was 75% after 15 hours of treatment with aluminum consumption of 17 g per g of extracted gallium.

Similar results in purifying a starting alkaline solution and extracting gallium were obtained when treating the solution with ferrous sulphide as reducer and with "grey" desiliconization sludge as reactant containing an alkaline-earth metal oxide. The composition of "grey" sludge was the following (in % by mass): calcium oxide 57.4; silicon dioxide 31;1 aluminum oxide 2.6; iron oxide 2.2; sodium oxide 1.6; magnesium oxide 1.4. The consumption of the reactants and treatment conditions were similar to those described in the preceding experiment.

EXAMPLE 13

An alkaline solution containing in g/l: sodium carbonate 277; sodium hydroxide 170; aluminum oxide 85.3; vanadium 0.02; chromium 0.06; gallium 0.6 was purified from impurities by treating the solution with sodium sulphide and calcium oxide. The consumption of sodium sulphide was 1 g per l of the solution, consumption of calcium oxide 45 g per l of the solution. The treatment of the solution with the above-specified reactants was conducted for three hours at 100° and 80° C with the reducer and calcium oxide, respectively.

After separation of a precipitate, the solution had the following composition in g/l: sodium carbonate 169; sodium hydroxide 242; aluminum oxide 78.8; vanadium 0.002; chromium less than 0.003; gallium 0.58.

Gallium was extracted by electrochemically reducing gallium from this solution on gallium based alloy containing 0.2% of aluminum and 5% of zinc in an alternating electromagnetic field of an intensity of 60000 A/m. Concentration of aluminum and zinc was maintained at the above levels by directly dissolving these metals in the alloy. The degree of gallium extraction was 87% after one hour of treatment with aluminum consumption of 14 g per g of extracted gallium l.

EXAMPLE 14

Gallium was extracted by electrochemically reducing gallium from a solution containing in g/l: sodium hydroxide 180; gallium 0.25 on liquid gallium with cathode polarization with direct current at a current density of 0.05 A/cm$^2$. The solution was contacted with the alloy at 50°-55° C in an alternating electromagnetic field of an intensity of 180000 A/m. The degree of gallium extraction was 93% after 20 minutes of treatment.

EXAMPLE 15

Gallium was extracted by electrochemically reducing gallium from a solution containing in g/l: sodium hydroxide 180 and gallium 75 on liquid gallium with cathode polarization of liquid gallium with direct current at a density of 0.075 A/cm². The solution was contacted with the alloy at 50°–55° C in an electromagnetic field of an intensity of 500000 A/m. The degree of gallium extraction after three hours of treatment was 97.3%. Yield by current was 91%.

EXAMPLE 16

Gallium was extracted from a solution containing in g/l: sodium carbonate 246; sodium hydroxide 69; aluminum oxide 10; chromium 0.8; vanadium 0.08; gallium, 0.15 by electrochemically reducing gallium on gallium based alloy containing 0.3% by mass of aluminum. The solution was contacted with the alloy in an alternating electromagnetic field of an intensity of 60000 A/m.

Vanadium and chromium were preliminarily reduced using the same alloy in the electromagnetic field with subsequent removal of the reduced elements from the solution.

Two methods of removing the impurities were tested: filtering and settling. The results showed that with the duration of the reduction process of 30–40 minutes substantially 100% of the impurities were removed from the solution by filtering or settling.

The degree of gallium extraction from the solution thus purified was 92% after 60 minutes of treatment. The consumption of reducer- aluminum- contained in the alloy was 24 g per g of extracted gallium.

Vanadium and chromium removed from the solution as described in this Example are suitable for further processing.

What is claimed is:

1. A process for the extraction of gallium from alkaline gallium-containing solutions comprising electrochemically reducing gallium on a liquid metal selected from the group consisting of gallium, an alloy of gallium and aluminum and an alloy of gallium, aluminum and zinc in an alternating electromagnetic field having an intensity of 1500 – 500,000 A/m.

2. A process according to claim 1 wherein the solution contains impurities hampering gallium extraction, said impurities are reduced and removed from the solution prior to the electrochemical reduction of gallium.

3. A process according to claim 2, wherein a reducer used has the oxidation potential which is higher than the reduction potential of the impurities.

4. A process according to claim 2, wherein the reduced impurities are removed by filtering or settling.

5. A process according to claim 2, wherein the reduced impurities are removed from the solution by treating the solution with a reactant containing an alkaline-earth element.

6. A process according to claim 1, wherein gallium is electrochemically reduced on liquid gallium.

7. A process according to claim 1, wherein gallium is electrochemically reduced on gallium based alloys containing aluminum in an amount of 0.05–0.5% by mass.

8. A process according to claim 1, wherein gallium is electrochemically reduced on gallium based alloys containing aluminum and zinc in an amount of 0.05–0.5% and 0.01–10% by mass, respectively.

9. A process according to claim 1, wherein gallium is electrochemically reduced under cathode polarization of a liquid metal material with direct current at a current density 0.001–0.1 A/cm².

* * * * *